US010388132B2

(12) United States Patent
Cutcher et al.

(10) Patent No.: US 10,388,132 B2
(45) Date of Patent: Aug. 20, 2019

(54) SYSTEMS AND METHODS FOR SURVEILLANCE-ASSISTED PATROL

(71) Applicant: MOTOROLA SOLUTIONS, INC., Chicago, IL (US)

(72) Inventors: Jeffrey L. Cutcher, Davie, FL (US); Daniel L. Cronin, Hollywood, FL (US); Rajesh Baliram Singh, Davie, FL (US); Rolando Hernandez, Miami, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 15/816,989

(22) Filed: Nov. 17, 2017

(65) Prior Publication Data

US 2019/0156640 A1 May 23, 2019

(51) Int. Cl.

| | |
|---|---|
| ***G08B 13/196*** | (2006.01) |
| ***G08B 13/194*** | (2006.01) |
| ***G08B 21/22*** | (2006.01) |
| ***G08B 21/04*** | (2006.01) |

(52) U.S. Cl.

CPC ..... *G08B 13/19608* (2013.01); *G08B 13/194* (2013.01); *G08B 13/196* (2013.01); *G08B 13/19602* (2013.01); *G08B 13/19613* (2013.01); *G08B 21/0415* (2013.01); *G08B 21/0423* (2013.01); *G08B 21/22* (2013.01)

(58) Field of Classification Search

CPC ..... G06K 9/00771; G08B 13/196; G08B 13/19602; G08B 21/22; G08B 19/608; G08B 19/196; G08B 19/19602; G08B 19/19613; G08B 21/0415; G08B 21/0423

See application file for complete search history.

(56) References Cited

U.S. PATENT DOCUMENTS

| | | | | |
|---|---|---|---|---|
| 5,091,780 A * | 2/1992 | Pomerleau | ..... | G06K 9/00771 348/152 |
| 6,591,006 B1 * | 7/2003 | Niemann | ..... | G06K 9/00771 348/154 |
| 7,683,929 B2 | 3/2010 | Elazar et al. | | |
| RE42,690 E | 9/2011 | Aviv | | |

(Continued)

*Primary Examiner* — Robert J Hance

(74) *Attorney, Agent, or Firm* — Michael Best & Friedrich LLP

(57) ABSTRACT

Systems and methods for surveillance-assisted patrol. One system includes an image capture device associated with a location, a patrol object, and a server communicatively coupled to the image capture device and the patrol object. The server includes an electronic processor configured to receive geolocation data for the patrol object. The electronic processor determines, based on the data, whether the patrol object is within a predetermined distance from the location, and, in response to determining that the patrol object is within the predetermined distance, captures a reference image of the location via the image capture device. The electronic processor accesses a second image corresponding to the location, captured at a different time than the reference image. The electronic processor compares the reference image to the second image to determine a difference. The electronic processor, in response to determining the difference, transmits, via the transceiver, a patrol alert to an electronic device.

20 Claims, 5 Drawing Sheets

(56) References Cited

U.S. PATENT DOCUMENTS

| | | | | |
|---|---|---|---|---|
| 2002/0071033 | A1* | 6/2002 | Gutta | G07C 9/00158 348/143 |
| 2002/0135483 | A1* | 9/2002 | Merheim | G06K 9/00771 340/573.1 |
| 2006/0005045 | A1* | 1/2006 | Nakase | G07C 9/00087 713/190 |
| 2006/0203090 | A1 | 9/2006 | Wang et al. | |
| 2016/0006988 | A1* | 1/2016 | Zhao | H04N 7/181 348/155 |
| 2016/0301877 | A1 | 10/2016 | Tang et al. | |

* cited by examiner

600

SYSTEMS AND METHODS FOR SURVEILLANCE-ASSISTED PATROL

BACKGROUND OF THE INVENTION

Law enforcement and other public safety personnel patrol various locations in an attempt to detect and prevent crime. Patrolling personnel use portable electronic devices to aid them in the performance of their duties. Such devices are able to determine and report geolocation data for patrolling personnel to dispatch and other systems. Patrols are most effective when patrolling personnel are able to fully observe the locations being patrolled. Also, in some embodiments, the presence of a patrol may deter crime in an area until the patrol leaves the area. Thus, a patrol may leave an area after observing no criminal activity only to later learn that criminal activity occurred shortly after their departure.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
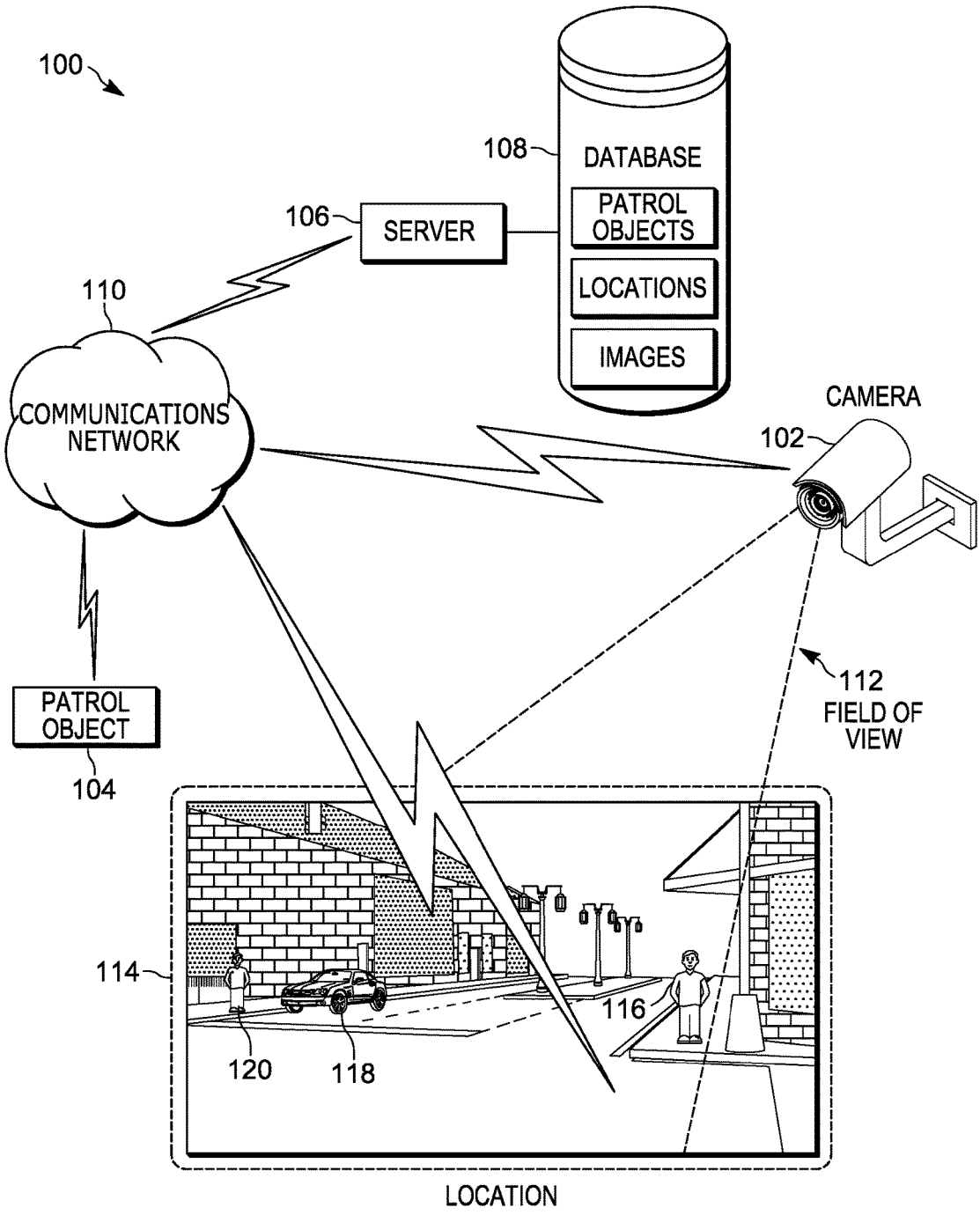
FIG. 1 is a diagram of a surveillance-assisted patrol system in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

As noted above, law enforcement and other public safety personnel patrol locations to prevent or detect crime. Criminals and other wrongdoers prefer not to attract the attention of law enforcement and, therefore, often use lookouts and conceal themselves when such patrols approach their vicinity. When concealed suspects are not detected by the patrols, the patrols are ineffective. To increase the effectiveness of the patrols at both deterring and detecting crime, embodiments described herein provide for, among other things, systems and methods for surveillance-assisted patrol.

Using such embodiments, stationary surveillance cameras are used to capture a reference image of a location when a patrol approaches a location and suspects or other wrongdoers are likely to be concealed from patrols. Suspects who have not concealed themselves (or who have begun to re-emerge) are detected by comparing the reference image with images captured before or after the patrol approaches the location. Accordingly, by comparing surveillance data between when a patrol is present in an area and when the patrol has left the area, suspects may be detected that otherwise would have gone undetected.

One example embodiment provides surveillance-assisted patrol system. The system includes an image capture device having a field-of-view associated with a location, a patrol object, and a server communicatively coupled to the image capture device and the patrol object. The server includes a transceiver and an electronic processor. The electronic processor is configured to receive geolocation data for the patrol object. The electronic processor is configured to determine, based on the geolocation data, whether the patrol object is within a predetermined distance from the location. The electronic processor is configured to, in response to determining that the patrol object is within a predetermined distance from the location, capture a reference image of the location via the image capture device. The electronic processor is configured to access a second image corresponding to the location. The second image is captured via the image capture device at a different time than the reference image. The electronic processor is configured to compare the reference image to the second image to determine a difference between the reference image and the second image. The electronic processor is configured to, in response to determining the difference, transmit, via the transceiver, a patrol alert to an electronic device.

Another example embodiment provides a method for surveillance-assisted patrol. The method includes receiving, with an electronic processor, geolocation data for a patrol object. The method includes determining, with the electronic processor, based on the geolocation data, whether the patrol object is within a predetermined distance from a location. The method includes, in response to determining that the patrol object is within a predetermined distance from the location, capturing a reference image of the location via an image capture device. The method includes accessing a second image corresponding to the location, the second image captured at a different time than the reference image. The method includes comparing the reference image to the second image to determine a difference between the reference image and the second image. The method includes, in response to determining the difference, transmitting, via a transceiver, a patrol alert to an electronic device.

For ease of description, some or all of the example systems presented herein are illustrated with a single exemplar of each of its component parts. Some examples may not describe or illustrate all components of the systems. Other example embodiments may include more or fewer of each of the illustrated components, may combine some components, or may include additional or alternative components.

FIG. 1 illustrates an example embodiment of a surveillance-assisted patrol system 100. In the example illustrated, the system 100 includes a camera 102, a patrol object 104, a server 106, and a database 108. The camera 102, the patrol object 104, and the server 106 are communicatively coupled via a communications network 110. The communications network 110 is an electronic communications network including wireless and wired connections. The communications network 110 may be implemented using a wide area network, such as the Internet, a local area network, such as a Bluetooth™ network or Wi-Fi, a Long Term Evolution (LTE) network, a Global System for Mobile Communications (or Groupe Special Mobile (GSM)) network, a Code Division Multiple Access (CDMA) network, an Evolution-Data Optimized (EV-DO) network, an Enhanced Data Rates for GSM Evolution (EDGE) network, a 3G network, a 4G network, and combinations or derivatives thereof The camera 102 is an electronic image capture device for capturing images and video streams. The camera 102 has a field-of-view 112, which defines the area depicted in images captured by the camera 102. The camera 102 is positioned such that the field-of-view 112 includes a portion of or the entire location 114. The camera 102 captures images by, for example, sensing light in at least the visible spectrum. In some embodiments, the camera 102 captures other types of images (for example, infrared images, thermal images, and the like). The camera 102 may be a surveillance camera, a traffic camera, or another suitable image capture device. The camera 102 communicates the captured images and video streams (image files) to the server 106 via, for example, the communications network 110. In some embodiments, the captured images have timestamps. In some embodiments, a timestamp may be embedded in the image file by the camera 102, such as metadata. In other embodiments, a timestamp may be communicated as a separate file from the image file or may be assigned by the server 106 upon receipt of an image file. The terms "image" and "images," as used herein, may refer to one or more digital images (for example, visible spectrum images, thermal images, infrared images, and the like) captured by the camera 102. Also, in some embodiments, the camera 102 may be a stereoscopic camera. In such embodiments, the camera 102 can capture three-dimensional information about the location 114. In some embodiments, three-dimensional information may be captured using radar sensors or infrared ranging sensors (not shown).

As described in more detail below, the server 106 is configured to automatically detect and identify objects in captured images of the location 114. For example, as illustrated in FIG. 1, several (non-patrol) objects are present at the location 114 within the field-of-view 112: a pedestrian 116, an automobile 118, and a suspect 120. Objects of interest may include, for example, automobiles or other vehicles, people, buildings, and the like. Varying numbers of such objects may be present at the location 114.

The patrol object 104 is an electronic device used by a public safety agency to patrol geographic areas, including the location 114. The patrol object 104 is capable of automatically reporting geolocation data for the patrol object 104 to the server 106. In some embodiments, the geolocation data is produced by the patrol object 104. In such embodiments, the patrol object includes global navigation satellite system. The global navigation satellite system receives radiofrequency signals from orbiting satellites using one or more antennas and receivers to determine geo-spatial positioning (for example, latitude, longitude, altitude, and speed) for the patrol object based on the received radiofrequency signals. Global navigation satellite systems are known, and will not be described in greater detail. In some embodiments, the global navigation satellite system may operate using the GPS (global positioning system). Alternative embodiments may use a regional satellite navigation system, and/or a land-based navigation system in conjunction with, or in place of, the global navigation satellite system. In some embodiments, the geolocation data may be received by the patrol object 104 from another device (for example, a global navigation satellite system of a vehicle).

The patrol object 104 may be a portable two-way radio, a smart telephone, a portable computing device, a vehicle-mounted communications or computing device, a vehicle control system of a police vehicle, or the like. Also, in some embodiments, the patrol object 104 may be an autonomous device, such as an aerial drone, an autonomous vehicle, or the like.

Figure 2:
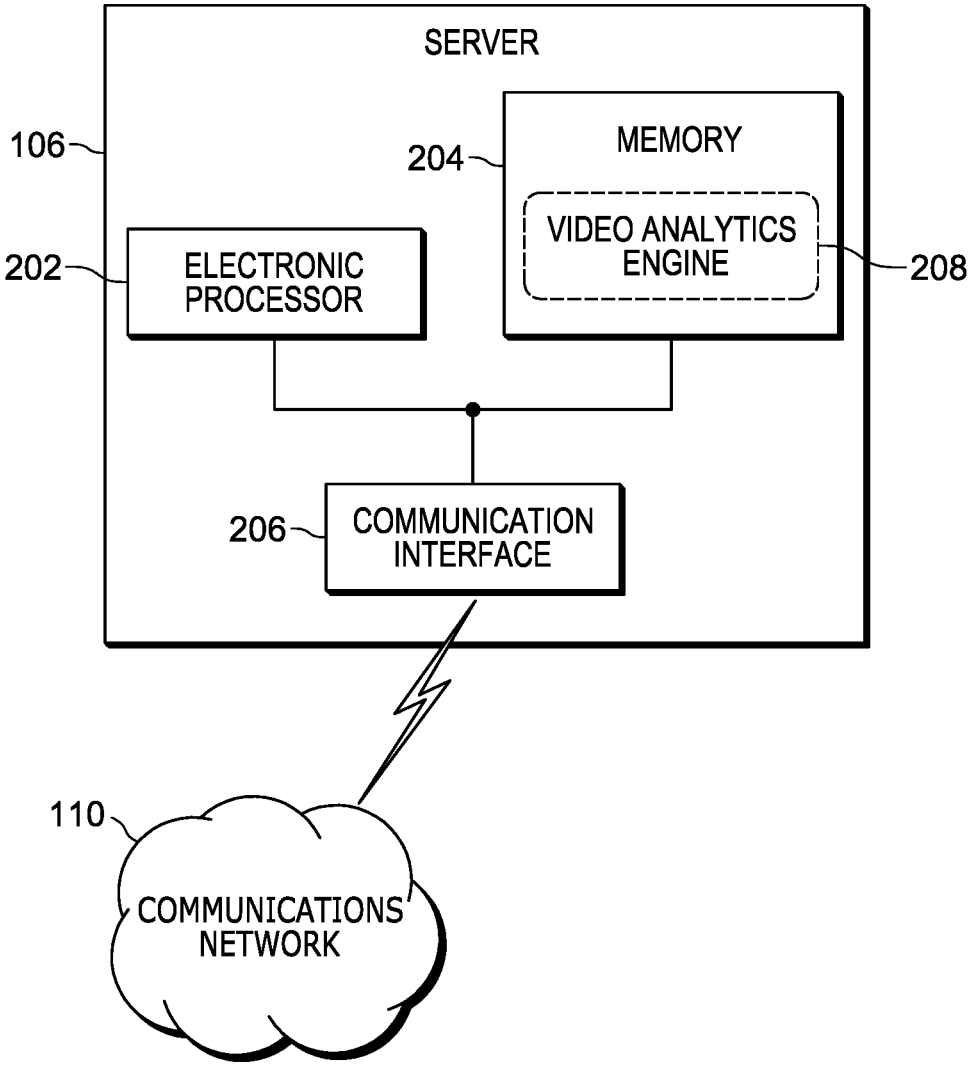
FIG. 2 is a diagram of a server of the system of FIG. 1 in accordance with some embodiments.

The server 106, described more particularly below with respect to FIG. 2, is communicatively coupled to and writes data to and from the database 108. As illustrated in FIG. 1, the database 108 may be a database housed on a suitable database server communicatively coupled to and accessible by the server 106. In alternative embodiments, the database 108 may be part of a cloud-based database system external to the system 100 and accessible by the server 106 over one or more additional networks. In some embodiments, all or part of the database 108 may be locally stored on the server 106. In some embodiments, as described below, the database 108 electronically stores data on patrol objects (for example, the type of patrol object or the type of entity utilizing the patrol object), locations patrolled by the patrol objects (for example, the location 114), and digital images (for example, images of the location 114 captured by the camera 102). In some embodiments, the server 106 and the database 108 are part of a computer-aided dispatch system. For example, the server 106 may use data stored in the database 108 and received from patrol objects (for example, the patrol object 104) to determine law enforcement patrol schedules or routes for or to dispatch personnel to areas including the location 114.

FIG. 2 illustrates an example of the server 106. In the embodiment illustrated, the server 106 includes an electronic processor 202, a memory 204, and a communication interface 206. The illustrated components, along with other various modules and components are coupled to each other by or through one or more control or data buses that enable communication therebetween.

The electronic processor 202 is a microprocessor or other suitable electronic device configured to obtain and provide information (for example, from the memory 204 and/or the communication interface 206), and process the information by executing one or more software instructions or modules stored in non-transitory medium. For example, the electronic processor 202 may be configured to retrieve and execute instructions from the memory 204, which may include random access memory ("RAM"), read only memory ("ROM"), other types of non-transitory computer readable medium, or a combination thereof. The software can include firmware, one or more applications, program data, filters, rules, one or more program modules, and other executable instructions. The electronic processor 202 is configured to retrieve from the memory 204 and execute, among other things, software related to the control processes and methods described herein.

As noted above, the memory 204 can include one or more non-transitory computer-readable media. In some embodiments, the memory 204 includes a program storage area and a data storage area. The program storage area and the data storage area can include combinations of different types of memory. In the embodiment illustrated, the memory 204 stores, among other things, a video analytics engine 208. The video analytics engine 208 analyzes images (for example, images captured by the camera 102) to, among other things, identify and detect objects within the images, such as by implementing one or more object classifiers. In some embodiments, the electronic processor 202 is configured to operate the video analytics engine 208 to detect the location of one or more patrol objects (for example, beat patrol officers or law enforcement vehicles) by analyzing captured images received from the camera 102 and other sources. For example, the electronic processor 202 may detect a vehicle in an image and identify it from the markings as a particular patrol object.

The communication interface 206 may include a wireless transmitter or transceiver for wirelessly communicating over the communications network 110. Alternatively or in addition to a wireless transmitter or transceiver, the communication interface 206 may include a port for receiving a cable, such as an Ethernet cable, for communicating over the communications network 110 or a dedicated wired connection. In some embodiments, the server 106 communicates with the camera 102, the patrol object 104, or both through one or more intermediary devices, such as routers, gateways, relays, and the like. As noted above, the server 106 receives captured images from the camera 102, and, as described in detail below, the electronic processor 202 included in the server 106 is configured to analyze and compare the captured images.

As noted above, suspects and other wrongdoers may attempt to conceal themselves when public safety patrols (for example, a foot patrol officer or a squad car) travel through or stop in an area (for example, the location 114). The patrols, therefore, may not detect any suspicious activity while in the area. However, the wrongdoers or suspects reemerge when the patrol has left the area. Thus, crimes may be committed in an area or criminal suspects may not be apprehended in an area despite the presence of law enforcement in the same area. As a consequence, there is a need for methods for surveillance-assisted patrols, which can direct patrols to an area based on the presence of wrongdoers, suspects, or other problematic situations.

Figure 3:
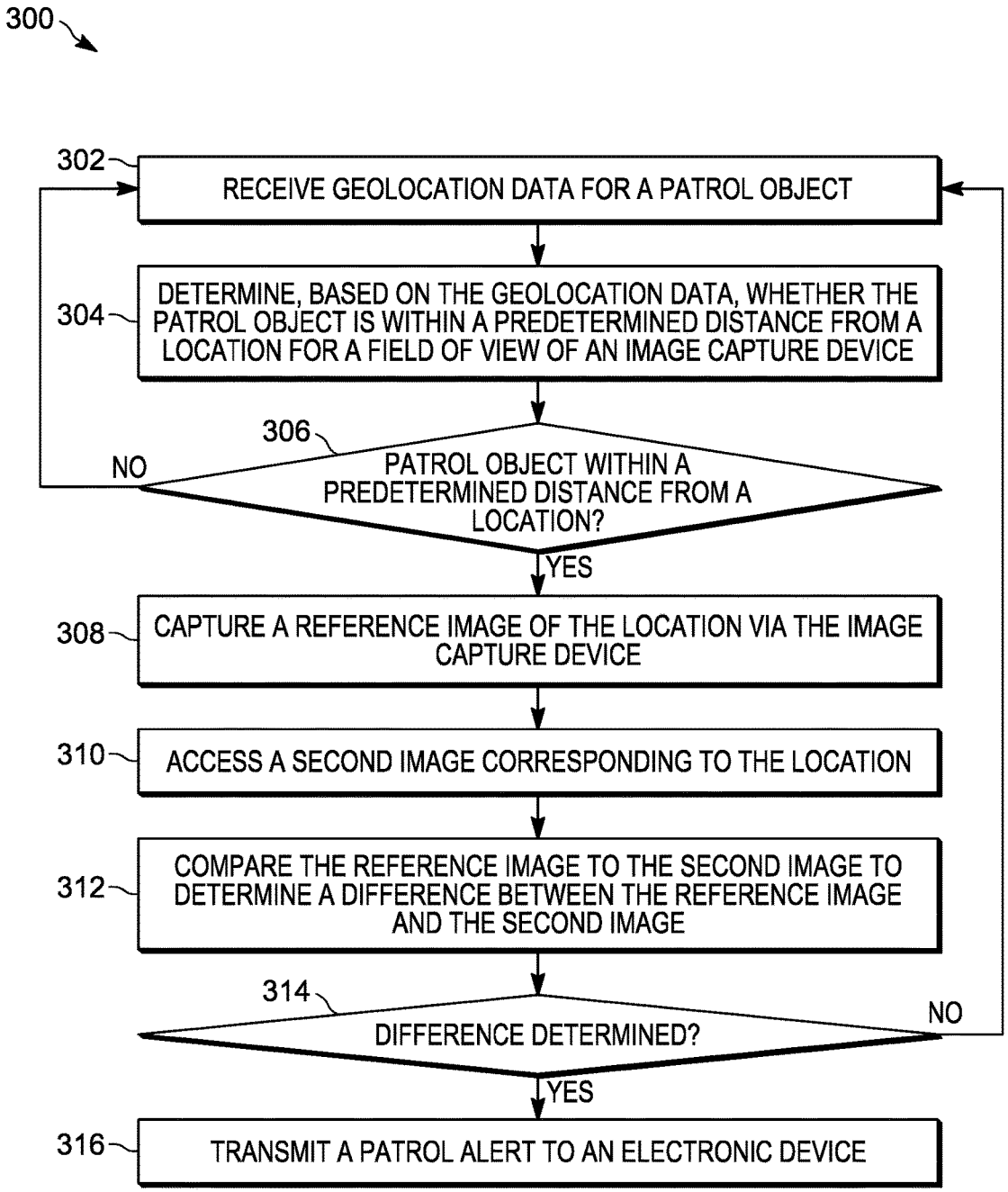
FIG. 3 is a flowchart of a method for surveillance-assisted patrol in accordance with some embodiments.
Figure 4:
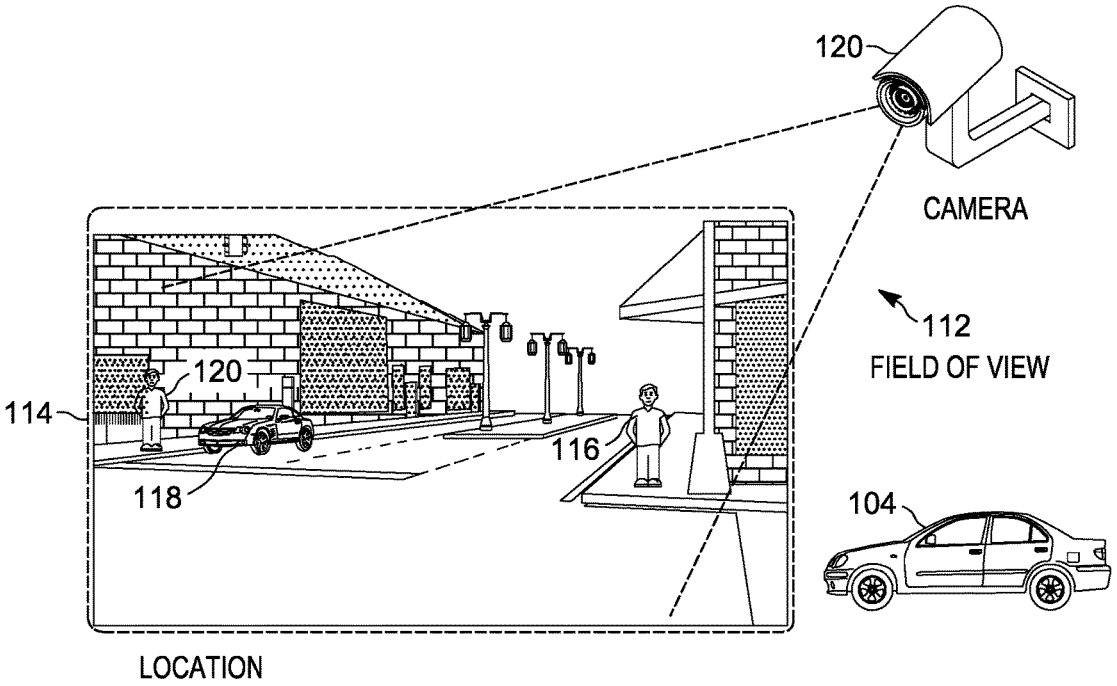
FIG. 4 is a diagram of a portion of the surveillance-assisted patrol system of FIG. 1 operating according to the method of FIG. 3 in accordance with some embodiments.

Accordingly, FIG. 3 illustrates a method 300 for surveillance-assisted patrol. The method 300 is described as being performed by the server 106 and, in particular, the electronic processor 202. However, it should be understood that in some embodiments, portions of the method 300 may be performed by other devices, including for example, the patrol object 104. For ease of description, portions of the method 300 are described in terms of a single patrol object in relation to a single location. For example, as illustrated in FIG. 4, the patrol object 104, represented by a police vehicle, is approaching the location 114. The location 114 is within the field-of-view 112 of the camera 102. The pedestrian 116, the automobile 118, and the suspect 120 are present at the location 114. It should be understood that embodiments of the method 300 may be used to direct multiple patrol objects at multiple locations.

As illustrated in FIG. 3, the electronic processor 202 receives geolocation data for the patrol object 104 (at block 302). In some embodiments, the electronic processor 202 receives geolocation data from the patrol object 104 via the communications network 110. In another embodiment, the electronic processor 202 receives the geolocation data from a database (for example, the database 108), which stores current and past geolocation data for the patrol object 104 (for example, as received from an automated vehicle location (AVL) system). Alternatively or in addition, in some embodiments, the geolocation data is determined by analyzing images received from the camera 102 or another image capture device. For example, the electronic processor 202 may analyze the captured images using the video analytics engine 208 to detect the patrol object 104. The geolocation data for the detected patrol object 104 may be determined based on the location where the image was captured.

As illustrated in FIG. 3, the electronic processor 202 also determines whether the patrol object 104 is within a predetermined distance from the location 114 (that is, a predetermined distance from portion of the location 114 within the field-of-view 112 of the camera 102) (at block 304). As noted above, any criminals or other wrongdoers (for example, the suspect 120) at the location 114 may attempt to conceal themselves when a patrol object is also in or near the location 114. Accordingly, the predetermined distance may be set such that it is likely that the patrol object 104 is or will soon be detected by any persons in the location 114. The predetermined distance may vary depending on the type of entity that is using the patrol object 104. For example, a police vehicle moves faster than a person on foot, is larger than a person on foot, has distinctive markings, and, thus, may be spotted from a greater distance than a foot patrol officer. As a consequence, when the patrol object 104 is a device carried by a foot patrol officer, the predetermined distance may be a smaller distance from the location 114 than when the patrol object 104 is a device present in a police vehicle. The predetermined distance may also be set based on attributes of the location 114 observed within the field-of-view 112. For example, if the location 114 is an open space or a space with relatively unobstructed views of the surrounding area, it may be easier to detect patrols as they approach, and the predetermined distance may be larger compared to the predetermined distance than if the location 114 is an enclosed area or a space with obstructed views of the surrounding area. The predetermined distance may also vary according to the time of day, weather conditions, or other factors that affect visibility and, therefore, at what distance the entity utilizing the patrol object 104 will likely be observable by a person located within the location 114. In some embodiments, the predetermined distance is a distance range.

In some embodiments, the electronic processor 202 determines whether the patrol object 104 is within the predetermined distance from the location 114 based on the geolocation data (received at block 302) for the patrol object 104. For example, the electronic processor 202 may determine whether the patrol object 104 is within the predetermined distance by comparing latitude and longitude for the patrol object 104 (included in the received geolocation data) with the latitudinal and longitudinal boundaries for portion of the location 114 that is within the field-of-view 112. Alternatively or in addition, the electronic processor 202 may determine whether the patrol object 104 is within the predetermined distance from the location 114 by detecting the patrol object 104 in an image captured by the camera 102. As noted above, the geolocation data may include direction and velocity information for the patrol object 104 (for example, the patrol object 104 is moving toward the location 114 at a speed of 25 miles per hour). In some embodiments, the electronic processor 202 determines from the direction and velocity data whether and when the patrol object 104 is within the predetermined distance.

Figure 5:
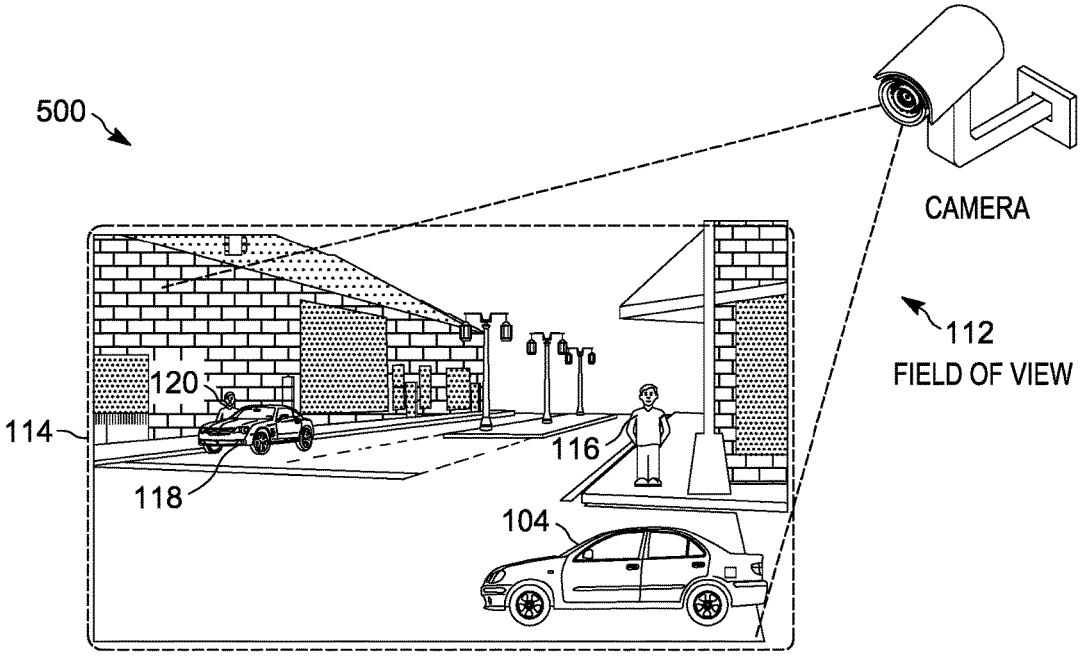
FIG. 5 is an example image captured using the method of FIG. 3 in accordance with some embodiments.

In some embodiments, when the patrol object 104 is not within the predetermined distance from the location 114 (at block 306), the electronic processor 202 continues to receive and process geolocation data (at block 302) as described above. However, in response to determining that the patrol object 104 is within the predetermined distance from the location 114 (at block 306), the electronic processor 202 captures a reference image of the location 114 via the camera 102 (at block 308). FIG. 5 illustrates an example reference image 500. As noted above, the presence of law enforcement patrols at the location 114 may cause the suspect 120 present at the location 114 to conceal himself or herself. For example, as illustrated in FIG. 5, the suspect 120 is concealed behind the automobile 118 as the patrol object 104 enters the location 114. In some embodiments, the electronic processor 202 controls the camera 102 to capture the reference image. In some embodiments, the electronic processor 202 extracts the reference image from a video stream received from the camera 102.

Figure 6:
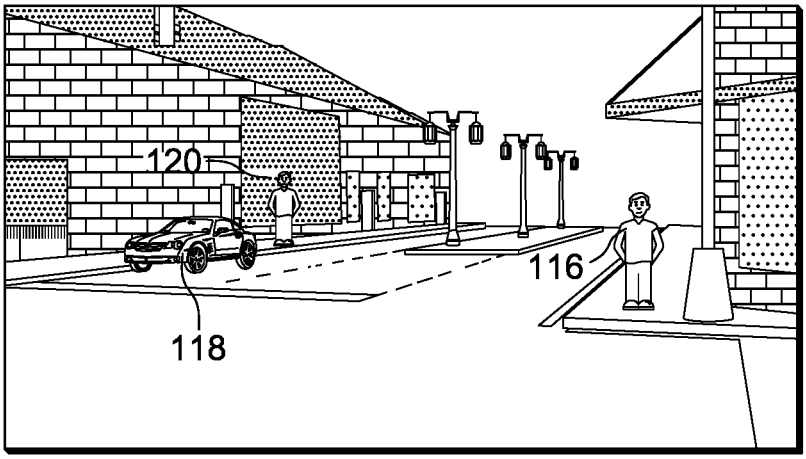
FIG. 6 is an example image captured using the method of FIG. 3 in accordance with some embodiments.

Returning to FIG. 3, the electronic processor 202 also accesses a second image corresponding to the portion of the location 114 that is within the field-of-view 112 (at block 310). FIG. 6 illustrates an example second image 600. As noted above, when law enforcement patrols are not present at a location, suspects are less likely to be concealed. Accordingly, the second image 600 may be captured via the camera 102 at a different time than the reference image 500. For example, in some embodiments, the second image 600 is captured after the reference image 500 (that is, after the patrol object 104 has left the location 114). In particular, in response to determining that the patrol object 104 is no longer within the predetermined distance from the location 114 (for example, based on received geolocation data), the electronic processor 202 may receive a second image 600 of the location 114 captured via the camera 102. In some embodiments, the second image 600 is captured by another image capture device having a field of view that also includes the location 114.

In some embodiments, the electronic processor 202 generates a plurality of images by periodically capturing an image of the location 114 from the camera 102, or by periodically extracting an image from a video stream received from the camera 102. In some embodiments, captured images (including reference images) include timestamps. As noted above, the images may be timestamped by camera 102 when they are captured, by the server 106 when the images are received or extracted, or by another suitable means. In some embodiments, the electronic processor 202 selects the second image 600 from the plurality of images based on the timestamps. For example, the electronic processor 202 may select an image captured at a time before or after the reference image 500 was captured (at block 308).

To detect whether concealed suspects were present during a patrol, the electronic processor 202 compares the reference image 500 to the second image 600 to determine a difference between the images (at block 312). In some embodiments, the electronic processor 202 determines a difference using the video analytics engine 208. In one example, the electronic processor 202 may use the video analytics engine 208 to detect a first plurality of objects (the pedestrian 116 and the automobile 118, but not the concealed suspect 120) in the reference image 500. Similarly, the electronic processor 202 may use the video analytics engine 208 to detect a second plurality of objects (the pedestrian 116, the automobile 118, and the unconcealed suspect 120) in the second image 600. The electronic processor 202 may then compare the first plurality of objects to the second plurality of objects to determine the difference (in this example, the suspect 120). In some embodiments, the electronic processor 202 compares the reference image 500 to more than one second image 600 to determine a difference.

In some embodiments, when the electronic processor 202 does not determine a difference between the images (at block 314), the electronic processor 202 continues to receive and process geolocation data for the patrol object 104 (at block 302).

When the electronic processor 202 determines a difference between the images (at block 314), the electronic processor 202 transmits, via a transceiver (for example, the communication interface 206), a patrol alert to an electronic device. In one example, the electronic processor 202 transmits the patrol alert to the patrol object 104 (via the communications network 110) that recently passed through the location 114. The patrol alert may instruct the patrol object 104 to return to the location 114. The patrol alert may be presented by the patrol object 104 to a user of the patrol object 104 as a haptic alert, an audio alert, a visual indication (for example, activating an LED), a text-based message, a graphical indication (for example, on a graphical user interface), or some combination of the foregoing. In another example, the electronic processor 202 transmits the patrol alert to a computer aided dispatch console, wherein the patrol alert instructs a dispatcher to send a patrol object to the location 114. In some embodiments, the electronic processor 202 transmits a patrol alert to a plurality of patrol objects that may be able to respond to the location 114. For example, the electronic processor 202 may transmit the patrol alert to all patrol objects located within a particular distance or within a particular response time from the location 114.

In some embodiments, the electronic processor 202 compares differences detected between the images 500 and 600 to a threshold to determine whether a patrol alert should be sent. For example, to account for minor differences between the reference image 500 and the second image 600, the electronic processor 202 may be configured to ignore differences that do not satisfy a particular threshold. As one example, the electronic processor 202 may be configured to generate and transmit a patrol alert only when one or more people are detected in the second image 600 but not in the reference image 500, when a vehicle is detected in the second image 600 but not in the reference image 500, or the like.

In some embodiments, the electronic processor 202 uses patrol alert timer to determine for how long to monitor a location after a patrol object has passed through the location. In one example, in response to determining that the patrol object 104 is within the predetermined distance from the location 114, the electronic processor 202 may establish a patrol alert timer (for example, five minutes). While the patrol alert timer has not expired, the electronic processor 202 may repeatedly access second images 600 and compare the second images 600 with the reference image 500 (at blocks 310-316). In some embodiments, the patrol alert timer is established after the patrol object 104 has left the location 114 (that is, when the patrol object 104 is no longer within the predetermined distance from the location 114).

Accordingly, by tracking the position of a patrol object, the systems and methods described herein are configured to focus surveillance on locations where patrol objects have recently passed through to detect suspicious behavior to may occur shortly after a patrol object has left an area. Thus, surveillance resources can be efficiently and effectively used to detect and stop criminal activity.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A surveillance-assisted patrol system, the system comprising:

an image capture device having a field-of-view associated with a location;

a patrol object;

a server communicatively coupled to the image capture device and the patrol object, the server including a transceiver and an electronic processor configured to receive geolocation data for the patrol object;

determine, based on the geolocation data, whether the patrol object is within a predetermined distance from the location; and in response to determining that the patrol object is within the predetermined distance from the location, (a) capture a reference image of the location via the image capture device, (b) access a second image corresponding to the location, the second image captured via the image capture device at a different time than the reference image, (c) compare the reference image to the second image to determine a difference between the reference image and the second image, and (d) in response to determining the difference, transmit, via the transceiver, a patrol alert to the patrol object.

2. The system of claim 1, wherein the electronic processor is further configured to, in response to determining that the patrol object is within the predetermined distance from the location, establish a patrol alert timer; and repeat steps (b)-(d) while the patrol alert timer has not expired.

3. The system of claim 1, wherein the electronic processor is further configured to determine whether the patrol object is within the predetermined distance from the location by determining whether the patrol object is entering or has entered the location based on the geolocation data.

4. The system of claim 1, wherein the electronic processor is further configured to access the second image corresponding to the location by determining that the patrol object is no longer within the predetermined distance from the location based on the geolocation data; and in response to determining that the patrol object is no longer within the predetermined distance from the location, capturing the second image of the location via the image capture device.

5. The system of claim 1, wherein the electronic processor is further configured to access the second image corresponding to the location by generating a plurality of images by periodically capturing an image of the location via the image capture device, each of the plurality of images including a timestamp; and selecting one of the plurality of images as the second image based on the timestamp of each of the plurality of images.

6. The system of claim 1, wherein the electronic processor is further configured to determine a difference between the second image and the reference image by detecting a first plurality of objects in the reference image;

detecting a second plurality of objects in the second image; and comparing the first plurality of objects to the second plurality of objects.

7. The system of claim 1, wherein the reference image is one selected from a group consisting of a visible spectrum image, an infrared image, and a thermal image.

8. The system of claim 1, wherein the second image is one selected from a group consisting of a visible spectrum image, an infrared image, and a thermal image.

9. The system of claim 1, wherein the patrol object is one selected from a group consisting of a portable two-way radio, a smart telephone, and a police vehicle.

10. A method for surveillance-assisted patrol, the method comprising:

receiving, with an electronic processor, geolocation data for a patrol object;

determining, with the electronic processor, based on the geolocation data, whether the patrol object is within a predetermined distance from a location; and in response to determining that the patrol object is within the predetermined distance from the location, (a) capturing a reference image of the location via an image capture device, (b) accessing a second image corresponding to the location, the second image captured at a different time than the reference image, (c) comparing the reference image to the second image to determine a difference between the reference image and the second image, and (d) in response to determining the difference, transmitting, via a transceiver, a patrol alert to the patrol object.

11. The method of claim 10, further comprising:

in response to determining that the patrol object is within the predetermined distance from the location, establishing a patrol alert timer; and repeating steps (b)-(d) while the patrol alert timer has not expired.

12. The method of claim 10, wherein determining whether the patrol object is within a predetermined distance from the location includes determining whether the patrol object is entering or has entered a field-of-view of the image capture device based on the geolocation data.

13. The method of claim 10, wherein accessing a second image corresponding to the location includes determining whether the patrol object is the predetermined distance from the location based on the geolocation data; and in response to determining that the patrol object is no longer within the predetermined distance from the location, capturing the second image of the location via the image capture device.

14. The method of claim 10, wherein accessing a second image corresponding to the location includes generating a plurality of images by periodically capturing an image of the location via image capture device, each of the plurality of images including a timestamp, and wherein accessing the second image includes selecting one of the plurality of images as the second image based on the timestamp of each of the plurality of images.

15. The method of claim 10, wherein determining a difference between the second image and the reference image includes detecting a first plurality of objects in the reference image;

detecting a second plurality of objects in the second image; and comparing the first plurality of objects to the second plurality of objects.

16. The method of claim 10, wherein capturing the reference image of the location includes capturing one selected from a group consisting of a visible spectrum image, an infrared image, and a thermal image.

17. The method of claim 10, wherein accessing the second image of the location includes accessing one selected from a group consisting of a visible spectrum image, an infrared image, and a thermal image.

18. The method of claim 10, wherein receiving the geolocation data for the patrol object includes receiving the geolocation data from one selected from a group consisting of a portable two-way radio, a smart telephone, and a police vehicle.

19. A method for surveillance-assisted patrol, the method comprising:

receiving, with an electronic processor, geolocation data for a patrol object;

determining, with the electronic processor, based on the geolocation data, whether the patrol object is within a predetermined distance from a location;

in response to determining that the patrol object is within the predetermined distance from the location, capturing a reference image of the location via an image capture device;

determining whether the patrol object is no longer within the predetermined distance from the location based on the geolocation data; and in response to determining that the patrol object is no longer within the predetermined distance from the location, capturing a second image of the location via the image capture device, comparing the reference image to the second image to determine a difference between the reference image and the second image, and in response to determining the difference, transmitting, via a transceiver, a patrol alert to an electronic device.

20. The method of claim 19, wherein transmitting the patrol alert to the electronic device includes transmitting the patrol alert to the patrol object.

* * * * *